US006672427B1

(12) United States Patent
Sheffield

(10) Patent No.: US 6,672,427 B1
(45) Date of Patent: Jan. 6, 2004

(54) LADDER BASE STABILISER

(75) Inventor: Lance Rodney Sheffield, Sevenoaks (GB)

(73) Assignee: Sandpiper Construction Limited, Canterbury (GB)

( * ) Notice: Subject to any disclaimer, the term of this patent is extended or adjusted under 35 U.S.C. 154(b) by 0 days.

(21) Appl. No.: 09/937,430

(22) PCT Filed: Mar. 27, 2000

(86) PCT No.: PCT/GB00/01149

§ 371 (c)(1),
(2), (4) Date: Sep. 26, 2001

(87) PCT Pub. No.: WO00/58593

PCT Pub. Date: Oct. 5, 2000

(30) Foreign Application Priority Data

Mar. 27, 1999 (GB) ..... 9907026

(51) Int. Cl.[7] ..... E06C 1/00
(52) U.S. Cl. ..... 182/172; 182/165
(58) Field of Search ..... 182/172, 180, 182/107, 105, 214, 111, 170, 200–204, 171, 169, 165, 175, 129, 25, 229; 248/354.1, 351, 188.2–188.5; 403/396, 325–329, 109, 192, 372, 377, 378; 285/138, 312–319, 29, 45; 16/229–233, 254–261, 277–281

(56) References Cited

U.S. PATENT DOCUMENTS

| | | | | | |
|---|---|---|---|---|---|
| 3,269,486 | A | * | 8/1966 | Machen | 182/170 |
| 3,508,628 | A | * | 4/1970 | Conrad | 182/172 X |
| 4,147,231 | A | * | 4/1979 | Chantler et al. | 182/172 |
| 4,565,262 | A | * | 1/1986 | Hawkins | 182/172 X |
| 4,632,220 | A | * | 12/1986 | Murrell | 182/172 X |
| 4,641,729 | A | * | 2/1987 | Beck et al. | 182/172 |
| 4,872,529 | A | | 10/1989 | Viets | 182/172 |
| 4,899,849 | A | * | 2/1990 | Levi et al. | 182/172 |
| 4,949,809 | A | * | 8/1990 | Levi et al. | 182/172 |
| 4,964,488 | A | * | 10/1990 | Stewart | 182/172 |
| 5,086,876 | A | * | 2/1992 | Severson | 182/172 |
| 5,387,048 | A | * | 2/1995 | Kuo | 403/109 |
| 5,462,133 | A | * | 10/1995 | Merrill, Jr. et al. | 182/172 |
| 5,511,632 | A | * | 4/1996 | Ermis | 182/172 |
| 5,715,908 | A | * | 2/1998 | Sager | 182/172 |
| 5,779,386 | A | * | 7/1998 | Eichhorn | 403/377 X |
| 5,868,222 | A | * | 2/1999 | Charbonneau | 182/172 |
| 6,065,566 | A | * | 5/2000 | Brown et al. | 182/172 |
| 6,354,629 | B1 | * | 3/2002 | McNeal et al. | 403/377 X |

FOREIGN PATENT DOCUMENTS

| | | | | |
|---|---|---|---|---|
| GB | 2042041 | * | 9/1980 | 182/172 |
| GB | 2200402 | * | 8/1988 | 403/372 |
| JP | 06088209 | | 11/1995 | |
| JP | 06206280 | | 3/1996 | |

* cited by examiner

*Primary Examiner*—Hugh B. Thompson
(74) *Attorney, Agent, or Firm*—David Silverstein; Andover-IP-Law

(57) ABSTRACT

A stabiliser for a ladder which enables the ladder to be safely used on sloping or uneven ground consists of spring loaded telescopic struts attached to the bottom of the ladder which are capable of compound rotary motion so that they can be opened to the required length and locked in position.

11 Claims, 5 Drawing Sheets

LADDER BASE STABILISER

Figure 1:
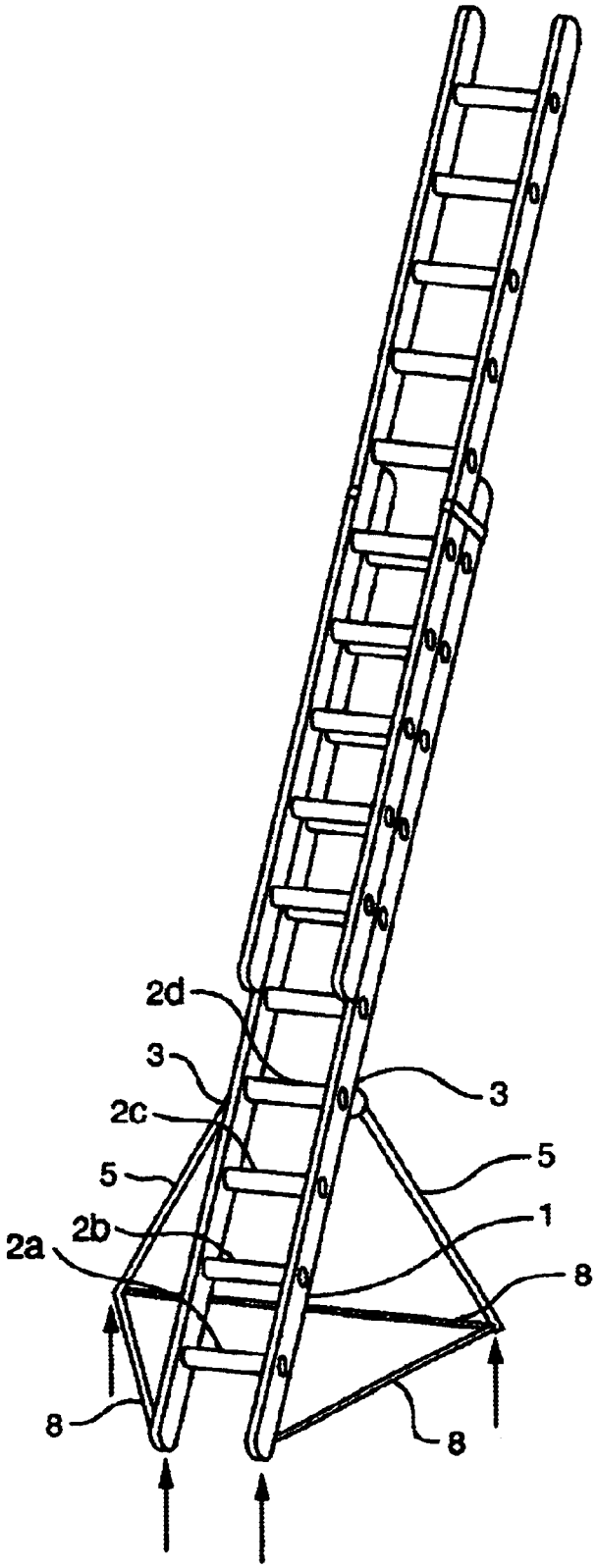

This invention relates to a ladder base stabiliser device and in particular it relates to a device which can be attached to or form part of a foot assembly of a ladder which can be used to prevent ladders from moving or slipping whilst is service, allowing ladders to be safely used on non level ground.

The use of ladders, particularly on uneven or sloping ground can give rise to safety problems, for example arising from ladder movement with the top of the ladder moving sideways, or from base slip when the bottom of the ladder moves away from the wall on which the top of the ladder is resting.

It is known that by widening the base of a ladder the ladder is made more stable reducing the tendency for sideways movement of the top of the ladder and there have been many patent applications made for inventions which try to overcome these and similar problems.

There are a number of ladder base stabilisers on the market that are either 'clip on' or 'bolt on' devices and which are designed to ensure greater safety in the use of ladders. These generally work well on solid level surfaces, but are far less effective on uneven, or sloping ground.

A known ladder stabiliser provides suitably restrained struts to the ground from points on the stiles a distance up from the base, with these struts leaning in the opposite direction to the ladder and outwards from the line of the stiles, forming a pyramid shape at the base. The ladder is both prevented from toppling sideways and the base is prevented from moving away from the wall on which the top of the ladder is resting.

This device can prove awkward in use and the difficult to store away.

I have devised an improved ladder base stabilising device allowing a ladder to be safely used whatever the slope of the ground and which is easier to use in practise.

The present invention overcomes the difficulties of stabilising ladders when founded on uneven, or sloping ground. It can be permanently fixed to the ladder and has minimum projection from the side of the ladder stile when not in use allowing easy ladder transport and storage. It is easy to operate and position allowing the job of making a ladder safe very quick and therefore far less likely to be overlooked. Being permanently secured to the ladder the device won't get lost or mislaid and with no loose components it is always ready for use.

The device of the present invention can be sold separately from a ladder and attached to a ladder or ladders can incorporate the device.

The device of the present invention can be used in conjunction with the ladder levelling device as described in Patent Application PCT/GB98/03465 in which there is disclosed a device that can accommodate uneven ground by adjusting the effective length of the ladder stiles and can also be used with a range of ladders.

According to the invention there is provided a ladder stabiliser device which comprises two telescopic arms or struts mounted on the outside of the ladder stiles at a distance up from the base of the ladder, the telescopic arms or struts being adapted so that, when the ladder is resting against a supporting wall, they are able to positioned so they are sloping outwards from the stiles and rearwards towards the wall or surface on which the top of the ladder is resting, the telescopic arms or struts being attached to the ladder through a double spring loaded device that enables there to be compound rotary motion of the telescopic arms or struts while at the same time forcing them to maintain a predetermined angular rotation in respect the ladder stile, both outwards and rearwards directions from the base of the ladder.

Preferably when not required the arms or struts can be manually rotated against the force of the springs so that the arms fold flat along the line of the ladder stiles. Preferably there is a simple clip which can oppose the double spring forces so that it will then hold the arms in the inoperative position against the style allowing easy storage and transport.

There can be ties which, in use, can link the struts together and also link them individually to the base of the ladder stiles.

The double spring loaded device removes the need to provide rigid ties between the base of the struts and the bottom of the ladder stiles in order to achieve correct angular positioning of the struts in relation to the ladder and, preferably the ties are non rigid e.g. made of a flexible rope, cord, chain etc.

Preferably the ties are made of a hard wearing material such as "Nylon" or similar straps that will withstand the rigours of use better than solid ties and do not suffer the disadvantage of solid ties which are very vulnerable to damage due to bending should anyone stand on them by mistake.

Preferably on the lower end of each telescopic arm or strut is mounted a foot component that allows movement in two directions, maintaining the adequate transfer of loads to the ground whatever the slope of the surface, e.g. with up to 10 degrees of crossfall being accommodated by movement of the foot component.

Preferably the main longitudinal components of the device will be constructed of extruded and hollow box sections. The design of the extruded sections allow the incorporation of end fixings generally without special machining operations.

In use to achieve the desired orientation from the storage to operating positions of the struts in relation to the ladder stiles requires two components of movement, 1. Rotation in line with the stiles and perpendicular to the line of the treads allowing the struts' feet to be located nearer to the wall or vertical surface on which the top of the ladder is resting than the base of the ladder.
2. A swing motion to extend the lower ends of the struts sideways, out from the ladder extending the width of the ladder base.

When used as stabilisers for access towers and the like the device only requires the second component, namely swing away from the perpendicular, as the uprights or posts on a tower, unlike a ladder stile, remain vertical.

In order to achieve these two components of movement while still effectively transmitting loads from the ladder through the strut to the ground there is preferably provided a hub and spring arrangement that allows these two components of movement to be achieved.

Preferably the unit is designed so that handed versions can be produced for each side of the ladder using identical internal components assembled the opposite way round so reducing the initial tooling costs.

The hub and spring unit preferably comprises a first component bolted to the ladder which consists of a chamber holding a spiral spring with one end of the spring being fixed in position in the chamber, the second component fits rotatably over the first component to form the other half of the spring chamber and is attached to a strut, the second component is attached to the other end of the spring so that relative rotation of the two components tensions the spring.

The unit is preferably made using injection moulded engineering grade plastics for the basic shells, alternative materials such as cast metal could be used.

The struts can be of any length for example a strut length of around a meter is suitable however there is no reason why the length should not be longer, providing greater stabilising capacity while utilising the same hub design and tie arrangement.

The preferred hub design, although it has end stops within the unit to limit further movement beyond the operating positions, preferably does not take cantilever forces, relying on the strap ties to provide the lateral restraint to the ends of struts.

With shorter strut lengths e.g. of or around half a meter, the hub design can be made stronger to provide greater resistance to limit further movement at the operating positions, thereby providing cantilever capability within the hub. This would allow the device to be used without physical ties or straps.

At the bottom of the struts a device as described in Patent Application PCT/GB98/03465 could be incorporated allowing easier final adjustment of the stabiliser. With the short version as above this would provide the only adjustment necessary. With the medium and longer versions, while making final adjustment easier, cheaper options could rely on simple tensioning of the ties.

In use, an embodiment of the invention uses a hub design which comprises a fixed injection moulded component securely bolted to the ladder stile, with a long bolt passing through a hollow rung which pulls together the first component of a pair of hub units on both sides of the ladder and attaches them to the ladder and projecting pins moulded as part of the back face of the unit provide load transfer to the stile, while allowing some to be easily broken off to accommodate the rung projection.

To assemble the chamber the spiral spring is held within the chamber by means of projecting lugs with an inner lug attaching one end of the spring to the chamber while the outer lug only temporally holds the other end of the spring until the second component is inserted and the spring tensioned.

Preferably on either side of the outer lug are two further smaller projections each with a ramp section nearest to the outer lug The spiral spring can be loosely wound and positioned within the unit in either direction, allowing the completed unit to be handed.

The outer or rotating moulded component holds the attachment to the struts and forms the other half of the circular spring chamber. When inserted into the fixed part, arms within the chamber pick up the end of the loosely coiled spring. Rotating the component then tensions the spring, with the ramps section correctly locating the spring. When fully tensioned the long bolt is fully tightened pulling the unit together so that projections lie within recess to limit overall rotation of the device in service.

Preferably the strut attachment arms include a spring-loaded roller device that acts on a sloping ramp so that the arms are caused to rotate outwards from the stile of the ladder.

The device is suitable for use with longer strut versions with ties at the lower ends of the struts. Where additional strength is required to limit rotation both rearwards and outwards for shorter cantilevered strut version with no end ties, a similar design would be used but with greater strength to take the forces involved.

The struts can be extended and, generally, the simplest way of providing a locking facility between two telescopic tubular components without loose bolts etc. is to have an internal spring with one or two projecting lugs attached that pass through the inner tube and engage into a series of holes in the outer tube.

Depressing the lug allows the outer tube to be moved until the lug springs out again through the next hole or, if the outer tube is rotated, the lug will miss the adjacent holes until the alignment is restored, a difficult and awkward operation even when there are guide marks to help. With square or rectangular tubes this rotation is not possible so this simple spring and lug device is not suitable when the telescopic movement required is more than just one or two holes. Another problem with this simple internal spring device is that it is very difficult to provide positive locking to prevent the lugs from being accidentally dislodged when under load due to excessive wear and elongation to the holes through the tubes, especially the inner, and they are also difficult to inspect without dismantling.

To overcome the above problems while still allowing large telescopic expansion and small incremental adjustment and the use of square or rectangular tubes I have devised a new development of the simple spring and attached lug arrangement and the invention also provides an improved device for locking together the two parts of the telescopic arms or struts, so that the overall length of the arms can be varied easily and quickly without any loose bolts etc. or awkward spring loaded pins.

The two telescopic tubes are locked together at the desired location by small metallic lugs attached to a pair of flat springs secured to the external surface of the outer tube. The lugs pass through a pair of holes in the outer tube and mate with a series of holes through the wall of the inner tube.

The depth of penetration of the lugs through into the inner tube is controlled by sloping wings formed as part of the springs projecting each side of the lug. To extract the lug these wings slide up inclined ramps, and to lock the lug in the fully inserted position, cams cover the wings preventing movement. In addition the wings have small reverse slopes on the leading edges that prevent the cams from fouling the wings during certain movements.

The operation of the telescopic arms is controlled by an injection moulded handle that completely surrounds the outer telescopic tube. The handle has a push button which, when depressed, allows the handle to move freely along the tube for a limited distance to be restrained by a pair of blocks within the handle fixed to the outer wall. In one embodiment the blocks also form the attachment of the springs to the outer tube as they have protecting pins moulded into the block that pass through the spring and into the wall of the tube, being totally contained within the moulded handle, there is no need to provide further fixing of the blocks or springs. When the push buttons are released the handle's position along the tube is further restrained in one of three possible positions, allowing the following:

Extracted—Lugs are pulled out from the inner tube and maintained in that position allowing totally free telescopic movement.

Free to Move—Lugs are free to move either in or out of the inner tube under the power of the spring that will push the lug through the next available hole in the inner tube when this is moved in or out, thus locking the tubes in that selected position.

Safety Locked—Lugs are fully inserted through both tubes and are physically restrained in that position.

The push button is supported by a moulded arm formed integral with the casing and operates a cam through a moulded lever and double hinge arrangement. This cam acts on the fixed blocks, to control and limit the movement of the handle to achieve the above three variations of position.

Using this device, adjustment can even be achieved with the user wearing thick gloves etc.

Figures 2A, 2B:
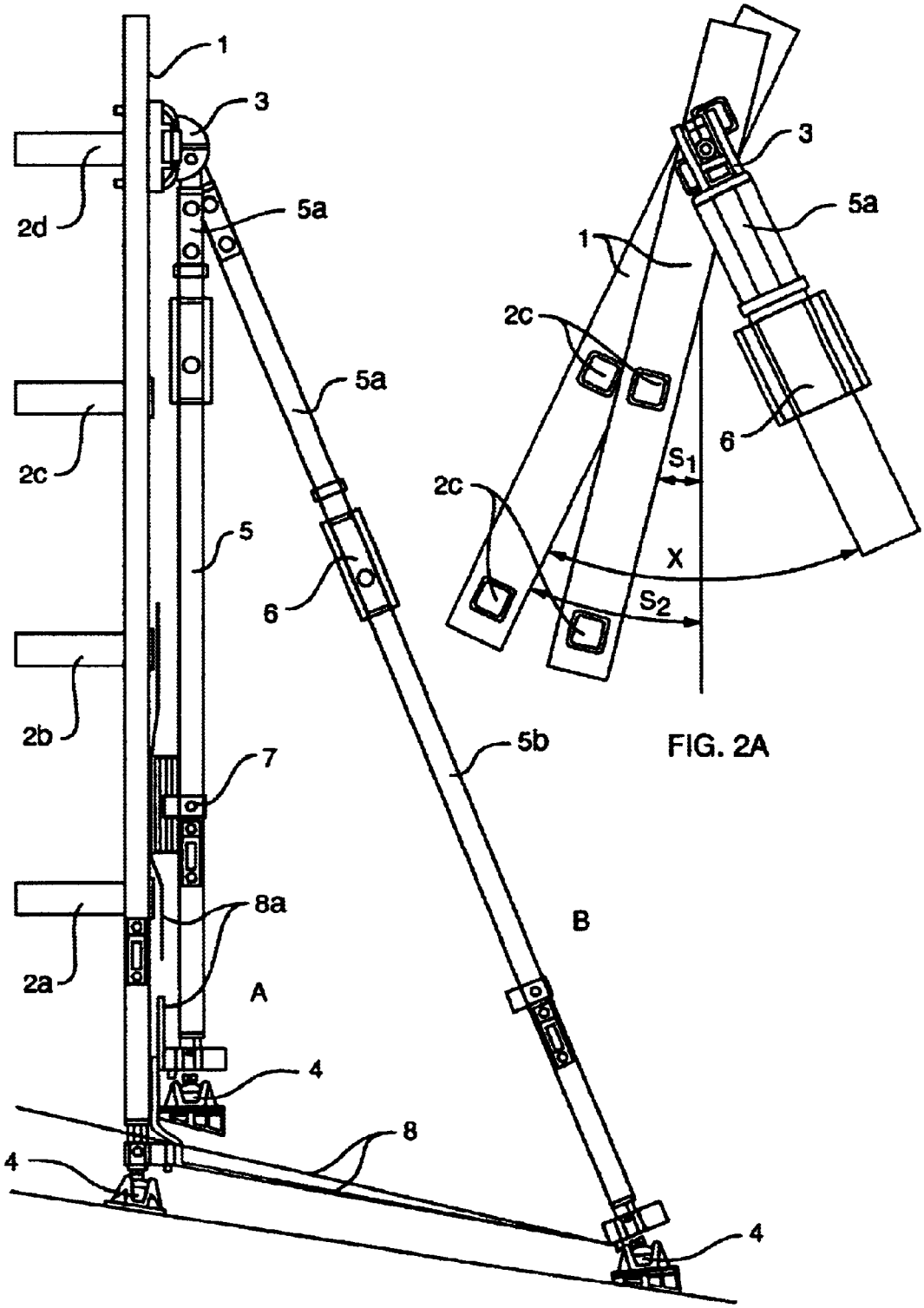
Figure 3E:
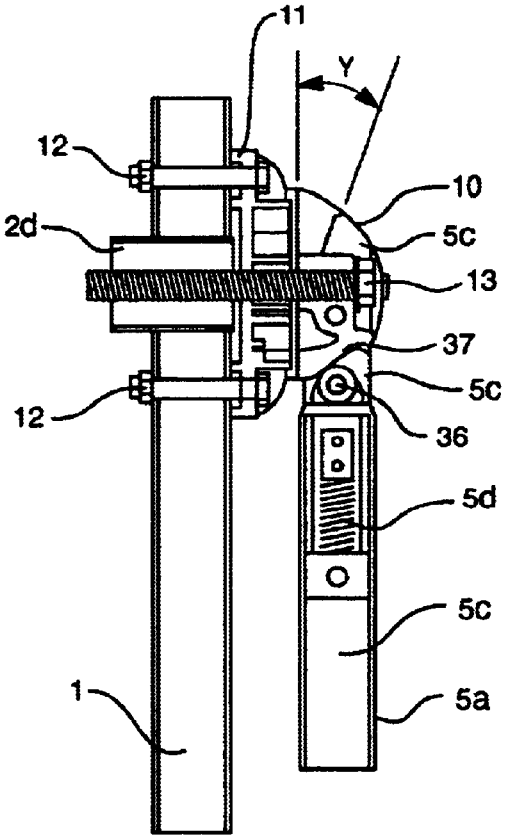
Figure 3A:
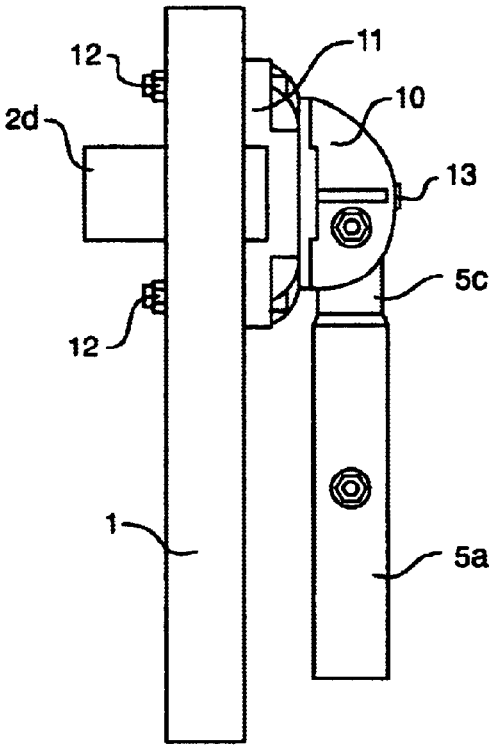
Figure 3B:
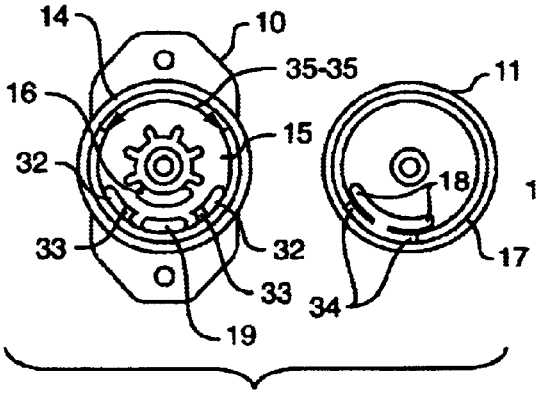
Figure 3C:
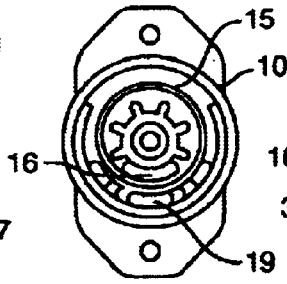
Figure 3D:
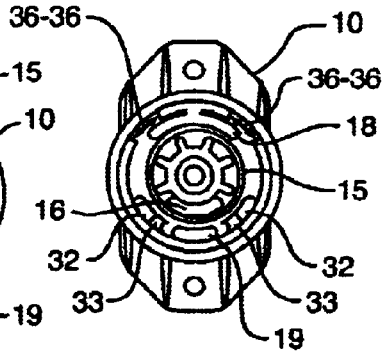

An embodiment of the invention is described in the accompanying drawings in which FIG. 1 shows the device in use FIGS. 2*a* and 2*b* show enlarged views of part of FIG. 1.

FIGS. 3*a*–3*e* show the attachment of the hub unit.

Figure 4B:
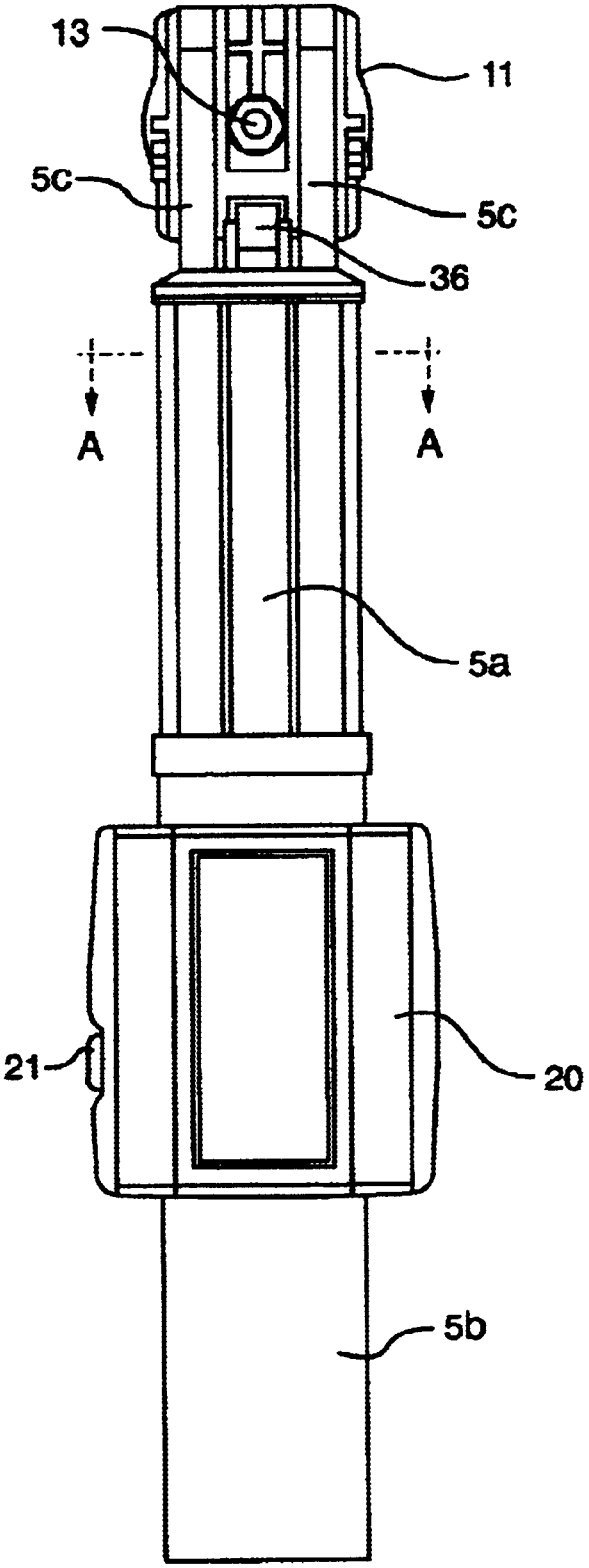
Figure 4A:
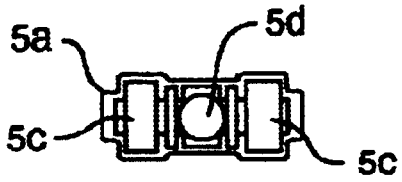

FIGS. 4*a* and 4*b* show the telescopic connector with FIG. 4*a* being a cross-sectional view along the line A—A of FIG. 4*b*.

FIGS. 5*a*–5*d* show additional details of a preferred handle configuration for use with the present invention.

Referring to FIGS. 1 and 2 a ladder has styles (1) and rungs (2*a*, 2*b*, 2*c*, 2*d* etc.). There is a stabiliser (5) attached to each side of the ladder. Each stabiliser (5) consists of two parts (5*a*) and (5*b*) telescopically joined together by connector (6). The stabiliser is attached to the side (1) by means of hub unit (3). The stabiliser (5) can be held against side (1) by means of clip (7) to store the stabiliser in position A. The stabiliser (5) has an adjustable foot (4) which can adjust to sloping ground as shown. The stabiliser (5) can move about hub unit (3) sideways as shown by FIG. 2*a* and forwards and backwards as shown by positions A and B respectively in FIG. 2*b*. There are ties (8) connecting the base of the ladder to the foot of stabiliser (5) and connecting the stabilisers together.

Referring to FIGS. 3*a*–3*e*, the stabilizer (5) consists of two components, the base component (10) and the top component (11). The component (10) is attached to (1) by means of bolts (12) and consists of a rim (14) in which there is an inner lug (16) to which is attached one end of spiral spring (15), the lug (16) holds the spring (15) permanently. There is an outer lug (19) which holds the spring (15) temporarily until the lid (11 ) is in position. The second component (11) consists of a rim (17) which rotatably fits over rim (14) so that projection (18) engages with the end (19) of the spring (15). Either side of lug (19) are two further small projections (31 and 32) with a ramp section (33) nearest to (19). The spring (15) can be loosely wound and positioned within the unit in either direction, allowing the complete unit to be handed. The component (11) is held on the ladder by means of bolt (13) which passes through a tine of the ladder to a similar unit on the other side of the ladder. When the lid (11) is placed on base (10), the arms (18) pick up the end of the spring (15) so rotation of the component (11) relative to component (10) will thus tighten up the spring (15) with the ramps (33) correctly locating the spring on (31 and 323). When fully tensioned the bolt (12) is tightened pulling the unit together so that the projections (34) lie within recess (35—35) which limits the overall rotation of the unit in use. This rotation will cause the stabilizer (5) to move sideways away from the ladder (1) against the tightening of the spring as shown in FIG. 2*a*. There is a spring loaded pivotal connection which includes a spring loaded roller (36) which acts on a sloping ramp (37) which enables the stabilizer (5) to move outwards from the ladder as shown in FIG. 2*b*.

Figure 5A:
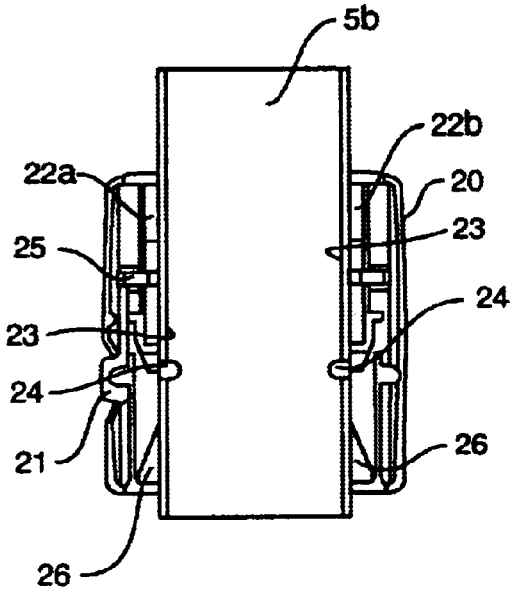

Referring to FIGS. 4*a* and 4*b*, the connector (6) consists of an injection moulded handle (20) the completely surrounds the outer telescopic tube (5*a*). The handle has push buttons (21) which, when depressed, allows the handle (20) to move freely along the tube (5*a*) for a limited distance, being restrained by a pair of blocks (22*a*, 22*b*) within the handle fixed to the outer wall. The blocks also form the attachment of the springs (23) to the outer tube (5*a*), as they have projecting pins moulded into the block that pass through the spring and into the wall of the tube and are totally contained within the moulded handle, so there is no need to provide further fixing of the blocks or springs. When the push buttons (21) are released the handle's position along the tube is further restrained in one of three possible positions, allowing the following:

Extracted—Lugs (24) are pulled out from the inner tube and maintained in that position allowing totally free telescopic movement (FIG. 5*a*)

Figure 5B:
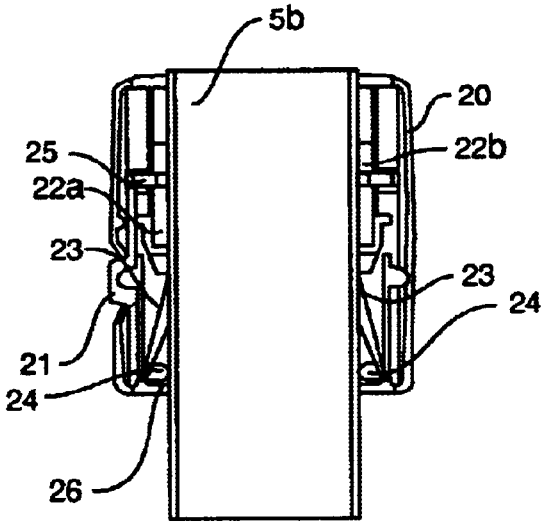
Figure 5C:
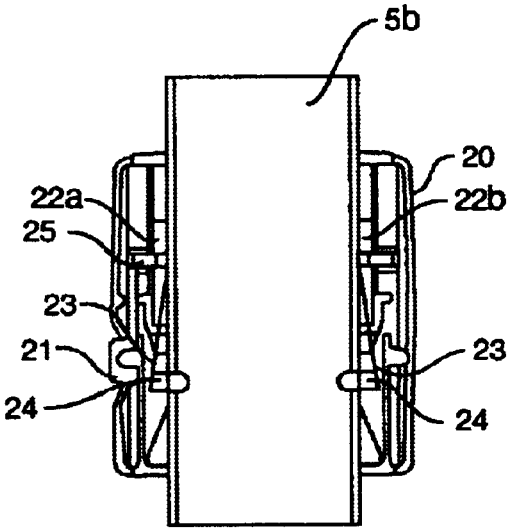

Free to Move—Lugs (24) are free to move either in or out of the inner tube under the power of the spring (23) that will push the lug through the next available hole (26) in the inner tube when this is moved in or out, thus locking the tubes in that selected position (FIG. 5*c*)

Safety Locked—Lugs (24) are fully inserted through both tubes and are physically restrained in that position (FIG. 5*a*).

The push button is supported by a moulded arm formed integral with the casing and operates a cam (25) through a moulded lever and double hinge arrangement This cam (25) acts on the fixed blocks (22*a* and 22*b*), to control and limit the movement of the handle to achieve the above three variations of position.

To operate the telescopic connector the following steps take place:

Extend Strut starting in the closed locked position—Position 3—FIG. 5*a*.

Press button—Cam (25) raised and handle (20) free to move.

Pull up handle—Ramp (26) within handle act on wings on side of spring to lift lug (24) and extract it from hole—moving to Position 1—FIG. 5*c*.

Release pressure on button (21)—Locked in Position 1 by cam.

Pull down handle—Extend telescopic strut so the end meets ground.

Press button—Push down handle a little flirter to lock in Position 2 FIG. 5*b*, if pushed down too far goes into over-ride position temporally FIG. 4*e*.

Lift up handle—disengage over-ride with lug (24) now free to locate in nearest hole in inner tube.

Release handle—handle drops under force of gravity to Position 3—Safety locked position FIG. 5*a*.

To Close Strut commencing for the Open Locked Position.

Press button (21) and keep pressed in—Handle free to move

Pull up handle—Ramp (26) within handle act on wings on side of spring to lift lug (24) and extract it from hole—moving to Position 1 FIG. 5*c*.

Continue pull, to raise telescopic section to the fully closed position

Figure 5D:
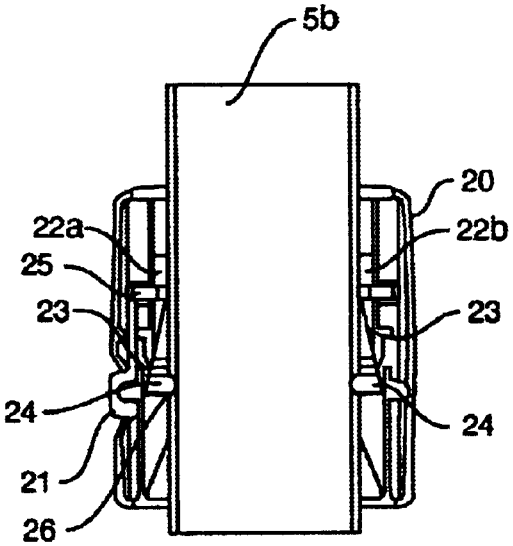

Move handle down release button (21) will go temporally into the over-ride position and will allow telescopic section to drop slightly FIG. 5*d*.

Lift up handle again to move into Position 1 FIG. 5*c*, allowing lug (24) to enter next available hole locking telescopic section in the fully closed position.

Release handle—handle drops under force of gravity to Position 3 FIG. 5*a*—Safety locked position.

What is claimed is:

1. A ladder base stabilizer device comprising stabilizer members for attachment to or forming part of a ladder assembly having main uprights but no opposing back uprights, said ladder assembly comprising upper and lower ends, two primary stile members, and rung members extending between said stile members, said stabilizer device being adapted to stabilize said ladder assembly against moving or slipping on surfaces of varying slope or contour while the ladder assembly is in service without needing to adjust the lengths of said stabilizer members each time the ladder assembly is repositioned, said stabilizer device comprising:

a strut member for connection to an associated primary stile member of said ladder assembly at a location between the upper and lower ends of said ladder assembly;

each strut member comprising telescoping upper and lower arm portions and a lock assembly whereby said arm portions can, alternatively, be slid relative to one another to adjust the length of said strut member or be locked to fix the length of the strut member; and, further wherein the lower arm portion of each strut member comprises a foot element adapted to rest on a surface, and also wherein the upper arm portion of each strut member comprises at least a portion of a hub unit which connects the upper arm portion to the associated primary stile member so as to enable limited compound rotary movement of said strut member relative to said primary stile member consistent with maintaining a predetermined angular rotation of the strut member relative to the primary stile member, wherein said hub unit comprises a hub and spring assembly to enable said limited compound rotary movement wherein a first component, which is bolted to the ladder assembly and comprising a first portion of a spring chamber holding a spiral hub spring with one end of the hub spring being fixed in position in the spring chamber, mates with a second component fitting rotatably over the first component to form a second portion of the spring chamber, said second component being attached to the associated strut member and to the other end of the hub spring such that relative rotation of the first and second components tensions the hub spring, and further wherein the hub and spring assembly includes end stops within said hub and spring assembly to prevent further movement beyond predetermined operating positions.

2. The ladder base stabilizer device according to claim 1 further comprising a spring loaded pivotal arm connection which includes a spring loaded roller which acts on a sloping ramp to cause a strut member to move outwards from the stile of the ladder.

3. A ladder base stabilizer device comprising stabilizer members for attachment to or forming part of a ladder assembly having main uprights but no opposing back uprights, said ladder assembly comprising upper and lower ends, two primary stile members, and rung members extending between said stile members, said stabilizer device being adapted to stabilize said ladder assembly against moving or slipping on surfaces of varying slope or contour while the ladder assembly is in service without needing to adjust the lengths of said stabilizer members each time the ladder assembly is repositioned, said stabilizer device comprising:

a strut member for connection to an associated primary stile member of said ladder assembly at a location between the upper and lower ends of said ladder assembly;

each strut member comprising telescoping upper and lower arm portions and a lock assembly whereby said arm portions can, alternatively, be slid relative to one another to adjust the length of said strut member or be locked to fix the length of the strut member; and, further wherein the lower arm portion of each strut member comprises a foot element adapted to rest on a surface, and wherein said foot element of said strut member is adapted to rest on a sloping surface by allowing movement in two planes and also wherein the upper arm portion of each strut member comprises at least a portion of a hub unit which connects the upper arm portion to the associated primary stile member so as to enable limited compound rotary movement of said strut member relative to said primary stile member consistent with maintaining a predetermined angular rotation of the strut member relative to the primary stile member, wherein said hub unit comprises a hub and spring assembly to enable said limited compound rotary movement wherein a first component, which is bolted to the ladder assembly and comprising a first portion of a spring chamber holding a spiral hub spring with one end of the hub spring being fixed in position in the spring chamber, mates with a second component fitting rotatably over the first component to form a second portion of the spring chamber, said second component being attached to the associated strut member and to the other end of the hub spring such that relative rotation of the first and second components tensions the hub spring, and further wherein the hub and spring assembly includes end stops within said hub and spring assembly to prevent further movement beyond predetermined operating positions.

4. A ladder base stabilizer device comprising stabilizer members for attachment to or forming part of a ladder assembly having main uprights but no opposing back uprights, said ladder assembly comprising upper and lower ends, two primary stile members, and rung members extending between said stile members, said stabilizer device being adapted to stabilze said ladder assembly against moving or slipping on surfaces of varying slope or contour while the ladder assembly is in service without needing to adjust the lengths of said stabilizer members each time the ladder assembly is repositioned, said stabilizer device comprising:

a strut member for connection to an associated primary stile member of said ladder assembly at a location between the upper and lower ends of said ladder assembly;

each strut member comprising telescoping upper and lower arm portions and a lock assembly whereby said arm portions can, alternatively, be slid relative to one another to adjust the length of said strut member or be locked to fix the length of the strut member, and wherein said lock assembly comprises an internal lock spring with at least a projecting lug which passes through one arm portion and engages with a series of holes in the other arm portion whereby the two arm portions can be locked together at a desired location, and also wherein said lugs are attached to a pair of flat springs secured to the external surface of one arm portion, the lugs passing through a pair of holes in that arm portion, and mating with a series of holes through the wall of the other arm portion, the depth of penetration of the lugs into the other arm portion being controlled by sloping wings formed as part of the springs projecting along each side of a lug, and further wherein cam elements cover the wings thereby preventing movement of the wings; and, further wherein the lower arm portion of each strut member comprises a foot element adapted to rest on a surface, and wherein the upper arm portion of each strut member comprises at least a portion of a hub unit which connects the upper arm portion to the associated primary stile member so as to enable limited compound rotary movement of said strut member relative to said primary stile member consistent with maintaining a predetermined angular rotation of the strut member relative to the primary stile member.

5. A ladder base stabilizer device comprising stabilizer members for attachment to or forming part of a ladder assembly having main uprights but no opposing back uprights, said ladder assembly comprising upper and lower ends, two primary stile members, and rung members extending between said stile members, said stabilizer device being adapted to stabilize said ladder assembly against moving or slipping on surfaces of varying slope or contour while the ladder assembly is in service without needing to adjust the lengths of said stabilizer members each time the ladder assembly is repositioned, said stabilizer device comprising:

a strut member for connection to an associated primary stile member of said ladder assembly at a location between the upper and lower ends of said ladder assembly;

each strut member comprising telescoping upper and lower arm portions and a lock assembly, wherein said lock assembly comprises an internal lock spring with at least a projecting lug which passes through one arm portion and engages with a series of holes in the other arm portion whereby the two arm portions can be locked together at a desired location whereby said arm portions can, alternatively, be slid relative to one another to adjust the length of said strut member or be locked to fix the length of the strut member; and, further wherein the lower arm portion of each strut member comprises a foot element adapted to rest on a surface, and also wherein the upper arm portion of each strut member comprises at least a portion of a hub unit which connects the upper arm portion to the associated primary stile member so as to enable limited compound rotary movement of said strut member relative to said primary stile member consistent with maintaining a predetermined angular rotation of the strut member relative to the primary stile member, wherein said hub unit comprises a hub and spring assembly to enable said limited compound rotary movement wherein a first component, which is bolted to the ladder assembly and comprising a first portion of a spring chamber holding a spiral hub spring with one end of the hub spring being fixed in position in the spring chamber, mates with a second component fitting rotatably over the first component to form a second portion of the spring chamber, said second component being attached to the associated strut member and to the other end of the hub spring such that relative rotation of the first and second components tensions the hub spring, and further wherein the hub and spring assembly includes end stops within said hub and spring assembly to prevent further movement beyond predetermined operating positions.

6. A ladder base stabilizer device comprising stabilizer members for attachment to or forming part of a ladder assembly having main uprights but no opposing back uprights, said ladder assembly comprising upper and lower ends, two primary stile members, and rung members extending between said stile members, said stabilizer device being adapted to stabilize said ladder assembly against moving or slipping on surfaces of varying slope or contour while the ladder assembly is in service without needing to adjust the lengths of said stabilizer members each time the ladder assembly is repositioned, said stabilizer device comprising:

a strut member for connection to an associated primary stile member of said ladder assembly at a location between the upper and lower ends of said ladder assembly;

each strut member comprising telescoping upper and lower arm portions and a lock assembly, wherein said lock assembly comprises an internal lock spring with at least a projecting lug which passes through one arm portion and engages with a series of holes in the other arm portion whereby the two arm portions can be locked together at a desired location, and wherein said lugs are attached to a pair of flat springs secured to the external surface of one arm portion, the lugs passing through a pair of holes in that arm portion, and mating with a series of holes through the wall of the other arm portion, the depth of penetration of the lugs into the other arm portion being controlled by sloping wings formed as part of the springs projecting along each side of a lug, and further wherein cam elements cover the wings thereby preventing movement of the wings, whereby said arm portions can, alternatively, be slid relative to one another to adjust the length of said strut member or be locked to fix the length of the strut member; and, further wherein the lower arm portion of each strut member comprises a foot element adapted to rest on a surface, and also wherein the upper arm portion of each strut member comprises at least a portion of a hub unit which connects the upper arm portion to the associated primary stile member so as to enable limited compound rotary movement of said strut member relative to said primary stile member consistent with maintaining a predetermined angular rotation of the strut member relative to the primary stile member, wherein said hub unit comprises a hub and spring assembly to enable said limited compound rotary movement wherein a first component, which is bolted to the ladder assembly and comprising a first portion of a spring chamber holding a spiral hub spring with one end of the hub spring being fixed in position in the spring chamber, mates with a second component fitting rotatably over the first component to form a second portion of the spring chamber, said second component being attached to the associated strut member and to the other end of the hub spring such that relative rotation of the first and second components tensions the hub spring, and further wherein the hub and spring assembly includes end stops within said hub and spring assembly to prevent further movement beyond predetermined operating positions.

7. A ladder base stabilizer device comprising stabilizer members for attachment to or forming part of a ladder assembly having main uprights but no opposing back uprights, said ladder assembly comprising upper and lower ends, two primary stile members, and rung members extending between said stile members, said stabilizer device being adapted to stabilize said ladder assembly against moving or slipping on surfaces of varying slope or contour while the ladder assembly is in service without needing to adjust the lengths of said stabilizer members each time the ladder assembly is repositioned, said stabilizer device comprising:

a strut member for connection to an associated primary stile member of said ladder assembly at a location between the upper and lower ends of said ladder assembly;

each strut member comprising telescoping upper and lower arm portions and a lock assembly whereby said arm portions can, alternatively, be slid relative to one another to adjust the length of said strut member or be locked to fix the length of the strut member; and, further wherein the lower arm portion of each strut member comprises a foot element adapted to rest on a surface, and also wherein the upper arm portion of each strut member comprises at least a portion of a hub unit which connects the upper arm portion to the associated primary stile member so as to enable limited compound rotary movement of said strut member relative to said primary stile member consistent with maintaining a predetermined angular rotation of the strut member relative to the primary stile member, wherein said hub unit comprises a hub and spring assembly to enable said limited compound rotary movement wherein a first component, which is bolted to the ladder assembly and comprising a first portion of a spring chamber holding a spiral hub spring with one end of the hub spring being fixed in position in the spring chamber, mates with a second component fitting rotatably over the first component to form a second portion of the spring chamber, said second component being attached to the associated strut member and to the other end of the hub spring such that relative rotation of the first and second components tensions the hub spring, and further wherein the hub and spring assembly includes end stops within said hub and spring assembly to prevent further movement beyond predetermined operating positions, said assembly further comprising a spring loaded pivotal arm connection, which includes a spring loaded roller, which can act on a sloping ramp on which a strut member is resting to cause the strut member to move outwards from the stile of the ladder, and also comprising a handle that completely surrounds one arm portion, said handle having a push button which, when depressed, allows the handle to move freely along the arm portion for a limited distance, wherein movement beyond said limited distance is restrained by a pair of blocks within the handle fixed to an outer wall of the arm portion.

8. A ladder base stabilizer device comprising stabilizer members for attachment to or forming part of a ladder assembly having main uprights but no opposing back uprights, said ladder assembly comprising upper and lower ends, two primary stile members, and rung members extending between said stile members, said stabilizer device being adapted to stabilize said ladder assembly against moving or slipping on surfaces of varying slope or contour while the ladder assembly is in service without needing to adjust the lengths of said stabilizer members each time the ladder assembly is repositioned, said stabilizer device comprising:

a strut member for connection to an associated primary stile member of said ladder assembly at a location between the upper and lower ends of said ladder assembly;

each strut member comprising telescoping upper and lower arm portions and a lock assembly whereby said arm portions can, alternatively, be slid relative to one another to adjust the length of said strut member or be locked to fix the length of the strut member; and, further wherein the lower arm portion of each strut member comprises a foot element adapted to rest on a surface, and also wherein the upper arm portion of each strut member comprises at least a portion of a hub unit which connects the upper arm portion to the associated primary stile member so as to enable limited compound rotary movement of said strut member relative to said primary stile member consistent with maintaining a predetermined angular rotation of the strut member relative to the primary stile member, wherein said hub unit comprises a hub and spring assembly to enable said limited compound rotary movement wherein a first component, which is bolted to the ladder assembly and comprising a first portion of a spring chamber holding a spiral hub spring with one end of the hub spring being fixed in position in the spring chamber, mates with a second component fitting rotatably over the first component to form a second portion of the spring chamber, said second component being attached to the associated strut member and to the other end of the hub spring such that relative rotation of the first and second components tensions the hub spring, and further wherein the hub and spring assembly includes end stops within said hub and spring assembly to prevent further movement beyond predetermined operating positions, said assembly further comprising a spring loaded pivotal arm connection, which includes a spring loaded roller, which can act on a sloping ramp on which a strut member is resting to cause the strut member to move outwards from the stile of the ladder, and also comprising a handle that completely surrounds one arm portion, said handle having a push button which, when depressed, allows the handle to move freely along the arm portion for a limited distance, wherein movement beyond said limited distance is restrained by a pair of blocks within the handle fixed to an outer wall of the arm portion, and also comprising pins moulded into each block and passing through a spring and into said wall of the arm portion, said pins being totally contained within the moulded handle, the push button being supported by a moulded arm formed integral with a casing and operating cam elements through a moulded lever and double hinge arrangement, the cam elements acting on the blocks to control and limit the movement of the handle to achieve variations of position of the handle.

9. A ladder assembly having main uprights but no opposing back uprights, said ladder assembly comprising upper and lower ends; two primary stile members; rung members extending between said stile members, wherein at least one of said rung members is hollow; and a ladder base stabilizer device comprising stabilizer members to stabilize said ladder assembly against moving or slipping on surfaces of varying slope or contour while the ladder assembly is in service without needing to adjust the lengths of said stabilizer members each time the ladder assembly is repositioned, said stabilizer device comprising:

a strut member for connection to an associated primary stile member of said ladder assembly at a location between the upper and lower ends of said ladder assembly;

each strut member comprising telescoping upper and lower arm portions and a lock assembly whereby said arm portions can, alternatively be slid relative to one another to adjust the length of said strut member or be locked to fix the length of the strut member; and, further wherein the lower arm portion of each strut member comprises a foot element adapted to rest of a surface, and wherein the upper arm portion of each strut member comprises at least a portion of a hub unit, comprising a double spring loaded assembly, which connects the upper arm portion to the associated primary stile member so as to enable limited compound rotary movement of said strut member relative to said primary stile member consistent with maintaining a predetermined angular rotation of the strut member relative to the primary stile member, and further wherein hub units are positioned on opposite stiles of the ladder assembly in alignment with opposite ends of a hollow rung element.

10. A ladder assembly having main uprights but no opposing back uprights, said ladder assembly comprising upper and lower ends; two primary stile members; rung members extending between said stile members, wherein at least one of said rung members is hollow; and a ladder base stabilizer device comprising stabilizer members to stabilize said ladder assembly against moving or slipping on surfaces of varying slope or contour while the ladder assembly is in service without needing to adjust the lengths of said stabilizer members each time the ladder assembly is repositioned, said stabilizer device comprising:

a strut member for connection to an associated primary stile member of said ladder assembly at a location between the upper and lower ends of said ladder assembly;

each strut member comprising telescoping upper and lower arm portions and a lock assembly whereby said arm portions can, alternatively be slid relative to one another to adjust the length of said strut member or be locked to fix the length of the strut member; and, further wherein the lower arm portion of each strut member comprises a foot element adapted to rest of a surface, and wherein the upper arm portion of each strut member comprises at least a portion of a hub unit, comprising a double spring loaded assembly, which connects the upper arm portion to the associated primary stile member so as to enable limited compound rotary movement of said strut member relative to said primary stile member consistent with maintaining a predetermined angular rotation of the strut member relative to the primary stile member, and further wherein hub units are positioned on opposite stiles of the ladder assembly in alignment with opposite ends of a hollow rung element, and further wherein each hub unit comprises a fixed component and a movable component able to move relative to said fixed component, wherein a bolt passes through said hollow rung element and through the fixed component of each of the two hub units thereby connecting the two fixed components to each other and to the respective primary stile members, and further comprising projecting pins moulded as part of each said fixed component to provide at least partial load transfer to the respective stile member, and wherein each said moveable component is attached to the respective upper arm portion of said strut member.

11. A ladder assembly having main uprights but no opposing back uprights, said ladder assembly comprising upper and lower ends; two primary stile members; rung members extending between said stile members, wherein at least one of said rung members is hollow; and a ladder base stabilizer device comprising stabilizer members to stabilize said ladder assembly against moving or slipping on surfaces of varying slope or contour while the ladder assembly is in service without needing to adjust the lengths of said stabilizer members each time the ladder assembly is repositioned, said stabilizer device comprising:

a strut member for connection to an associated primary stile member of said ladder assembly at a location between the upper and lower ends of said ladder assembly;

each strut member comprising telescoping upper and lower arm portions and a lock assembly whereby said arm portions can, alternatively be slid relative to one another to adjust the length of said strut member or be locked to fix the length of the strut member; and, further wherein the lower arm portion of each strut member comprises a foot element adapted to rest of a surface, and wherein the upper arm portion of each strut member comprises at least a portion of a hub unit, comprising a double spring loaded assembly, which connects the upper arm portion to the associated primary stile member so as to enable limited compound rotary movement of said strut member relative to said primary stile member consistent with maintaining a predetermined angular rotation of the strut member relative to the primary stile member, and further wherein hub units are positioned on opposite stiles of the ladder assembly in alignment with opposite ends of a hollow rung element, and further wherein each hub unit comprises a fixed component and a movable component able to move relative to said fixed component, wherein a bolt passes through said hollow rung element and through the fixed component of each of the two hub units thereby connecting the two fixed components to each other and to the respective primary stile members, and further comprising projecting pins moulded as part of each said fixed component to provide at least partial load transfer to the respective stile member, and wherein each said moveable component is attached to the respective upper arm portion of said strut member, wherein each of said fixed components comprises a first portion of a spring chamber holding a spiral hub spring, with one end of the hub spring being fixed in position in the chamber, and further wherein the moveable component fits rotatably over the fixed component to form the second portion of the spring chamber, said second portion being attached to the upper arm portion, and wherein the moveable component is also attached to the other end of the hub spring so that relative rotation of the two components tensions the hub spring to provide at least partial load transfer to the associated stile member.

* * * * *